US008651844B2

(12) United States Patent
Diekmann

(10) Patent No.: US 8,651,844 B2
(45) Date of Patent: Feb. 18, 2014

(54) HYBRID PUMP FOR DELIVERING A LIQUID PUMP MEDIUM

(75) Inventor: Ralf Diekmann, Bielefeld (DE)

(73) Assignee: Horn GmbH & Co. KG (DE)

( * ) Notice: Subject to any disclaimer, the term of this patent is extended or adjusted under 35 U.S.C. 154(b) by 528 days.

(21) Appl. No.: 12/673,282

(22) PCT Filed: Jul. 28, 2008

(86) PCT No.: PCT/EP2008/006186

§ 371 (c)(1),
(2), (4) Date: Jun. 9, 2011

(87) PCT Pub. No.: WO2009/033526

PCT Pub. Date: Mar. 19, 2009

(65) Prior Publication Data

US 2011/0236241 A1 Sep. 29, 2011

(30) Foreign Application Priority Data

Sep. 7, 2007 (DE) ..... 20 2007 012 565 U

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |

(52) U.S. Cl.
USPC ..... 418/250; 418/266; 418/267; 418/268

(58) Field of Classification Search
USPC ..... 418/55.1, 209, 210, 225, 58, 250, 418/266–268
See application file for complete search history.

(56) References Cited

U.S. PATENT DOCUMENTS 3,953,146 A * 4/1976 Sowards ..... 415/121.1
7,325,517 B2 * 2/2008 Dick et al. ..... 123/18 R (Continued)

FOREIGN PATENT DOCUMENTS

| | | | |
|---|---|---|---|
| DE | 29 16 858 | A1 | 11/1980 |
| DE | 101 58 146 | A1 | 6/2003 |
| DE | 20 2005 007 789 | U1 | 9/2006 |
| DE | 20 2005 007789 | U1 | 9/2006 |

OTHER PUBLICATIONS

Machine Translation DE 202005007789 Translation Done Apr. 22, 2013.*

(Continued)

*Primary Examiner* — Thomas Denion
*Assistant Examiner* — Dapinder Singh
(74) *Attorney, Agent, or Firm* — Andrus Intellectual Property Law, LLP

(57) ABSTRACT

The invention relates to a hybrid pump for delivering a liquid pump medium, comprising a rotor consisting of substantially non-elastic plastic, which is situated in the pump chamber and can rotate about a rotor axis. Said rotor has a base plate associated with the lower lateral surface of the pump chamber and several rotor parts that are spaced substantially at a uniform distance around the periphery, extend towards the opposite lateral surface of the pump chamber and are permanently connected to the base plate. A preferably curved rotor blade is pivotally hinged on the outer end of each rotor part, forming pump chambers of the rotor between neighboring rotor parts and rotor blades, said chambers being open towards the upper lateral surface of the pump chamber and the bases of said chambers being formed by the base plate of the rotor. The pump is characterized in that the bases of the pump chambers follow a concave arc, rising from the outer edge of the base plate inward towards the rotor axis.

20 Claims, 6 Drawing Sheets

(56) References Cited

U.S. PATENT DOCUMENTS

| | | | | |
|---|---|---|---|---|
| 7,381,038 | B2 * | 6/2008 | Hwang et al. | 418/59 |
| 7,392,768 | B2 * | 7/2008 | Dick et al. | 123/18 R |
| 2003/0091454 | A1 * | 5/2003 | Raymond | 418/188 |
| 2005/0019198 | A1 * | 1/2005 | Salomon | 418/268 |
| 2006/0191510 | A1 * | 8/2006 | Watkins et al. | 123/241 |

OTHER PUBLICATIONS

International Search Report for parent application PCT/EP2008/006186, having a mailing date of Jan. 19, 2009.

* cited by examiner

HYBRID PUMP FOR DELIVERING A LIQUID PUMP MEDIUM

CROSS-REFERENCE TO RELATED APPLICATIONS

This application is the U.S. national stage application of International Application No. PCT/EP2008/006186, filed Jul. 28, 2008, which International application was published on Mar. 19, 2009, as International Publication No. WO 2009/033526 A1 in the English language, which application is incorporated herein by reference. The International application claims priority of German Patent Application No. 20 2007 012 565.8, filed Sep. 7, 2007, which application is incorporated herein by reference.

BACKGROUND

The invention relates to a hybrid pump for delivering a liquid pump medium.

In the present case, a hybrid pump is understood to mean a pump that operates in a first mode as a displacement machine and in a second mode as a continuous-flow machine, in order to combine the respective advantages of these two pump types.

A known hybrid pump (DE 101 58 146 A1) has a housing that is equipped with an inlet, an outlet and a pump space. In cross section, the pump space has a substantially round or rounded running surface for a rotor with rotor blades that is rotatable about a rotor axis, and a respective side face on each side of the rotor. The rotor is arranged eccentrically in the pump space, wherein each of the rotor blades is also movable relative to the rotor. Together with the running surface of the pump space, the rotor blades define a plurality of pump chambers. In one embodiment, it is provided that at least the inlet is arranged in the side face of the pump space.

The fact that the filling and emptying of the pump chambers during the pumping operation is not optimal is problematic in the known hybrid pump. It was possible to demonstrate, for instance, that the pump medium is only slightly exchanged in the part of the pump chambers facing the rotor axis. This was not significantly improved by the arrangement of the inlet or the outlet in the side face of the pump chamber. The volume of the pump chambers is thus only insufficiently used in the pumping operation.

It must also be taken into account that the arrangement of the inlet or the outlet in the side face of the pump chamber is fundamentally linked to a deflection of the pump medium by roughly 90°, depending on the design. At least in the part of the pump chambers facing the rotor axis, this leads to the formation of a dead space that is not utilized in the filling of the pump chambers. This leads to an insufficient filling of the pump chambers. The resulting efficiency of this pump is low.

The above-explained, known hybrid pump has already been configured and refined in regard to improved efficiency (DE 20 2005 007 789 U1), specifically, by using a rotor consisting of chemically-resistant, essentially inelastic plastic, in particular, PEEK, and having a baseplate, on which the stationary rotor parts are fixedly mounted, that is associated with one side face of the pump space. A curved rotor blade is pivotably hinged to the outer end of each stationary rotor part. Between adjacent rotor parts and rotor blades, the pump chambers of the rotor are formed, which are opened towards the upper side face of the pump chamber as previously, but closed off by the baseplate.

In the above-explained prior art, from which the invention proceeds, the design of the rotor is used to arrange the inlet or the outlet in the upper side face of the pump space in such a manner that the geometric rotor axis runs through the inlet or the outlet.

The flow path of the pump medium first runs along the rotor axis and then into the respective pump chamber. This has the effect that the pump chambers are filled at least in part from a position that is as close as possible to the rotor axis. The rotor is thus penetrated by the pump medium in a certain sense. The above-described formation of a dead space in the pump chambers can thereby be largely avoided. Consequently, the quality of the filling of the pump chambers during pumping operation increases.

Structurally, it is necessary in the solution proposed to construct a part of the area surrounding the rotor axis with a hollow shape, at least over part of the axis, in order to be able to use this area as an inlet. A number of design possibilities exist for this, wherein it must be taken into account that a short circuit between the inlet and outlet must be avoided.

A rotor of the above-described type that is penetrated to a certain extent by the pump medium cannot be used in all circumstances for a hybrid pump. The teaching of the present invention is therefore based on the problem of increasing the efficiency of the known pump with a rotor having a baseplate, without constructing a part of the area surrounding the geometric rotor axis with a hollow shape.

SUMMARY

As described previously, the rotor is advantageously constructed of chemically-resistant, essentially inelastic plastic, in particular, PEEK. The efficiency is increased in this hybrid pump by the fact that the flow profile of the liquid pump medium in the pump chambers is made uniform. This is achieved by providing the bottoms of the pump chambers with a suitably curved profile, causing a uniform deflection of the flow. At the same time, the unused dead spaces in the pump chambers are reduced. The curved bottoms of the pump chambers now run where previously, due to a rather angular profile of the pump chambers, residues of the liquid pump medium were left behind that hindered the uniform flow of the liquid pump medium.

Since the rotor of the hybrid pump according to the invention is asymmetrically shaped relative to the operating direction of rotation, it is additionally advisable for the bottoms of the pump spaces to have an overlapped, spiral-shaped profile towards the rotor axis. They thus not only rise in a concave curved shape, but also run in a curved shape in the circumferential direction, starting from an outer, rather tangential section, towards the rotor axis.

The baseplate of the rotor is correspondingly shaped. In general, it is not a flat, smooth plate but rather has a variously contoured construction that provides corresponding profiles in the surface and on the edges.

It is provided according to a particularly preferred teaching that the stationary rotor parts run in a curved shape in the circumferential direction of the rotor, and that, in a plan view onto the rotor, each of the bottoms of the pump spaces runs radially outwards in an arc shape following the profile of the adjacent stationary rotor part. This has the effect that the baseplate does not run in a smooth circular shape at the outer periphery, but rather has steps corresponding to the individual rotor blades.

Overall the hybrid pump according to the invention aims to realize low-turbulence flow conditions on and in the rotor that are as uniform as possible. For this purpose, it is advisable according to a further preferred teaching of the invention that the movable rotor blades extend into the plane of the baseplate, preferably exactly up to its underside, and that the curved profile of the inside of the rotor blades matches the curved profile of the outer edge of the bottoms, so that the rotor blades make good contact at the outer edges of the bottoms.

In the hybrid pump according to the invention, where the rotor blades consist of essentially inelastic plastic, in particular of PEEK, on the correspondingly shaped rotor, it is advisable to realize a guide for the rotor blades at the outlet in the running surface of the pump space. This has the effect that, when passing the outlet in the running face of the pump space, the rotor blades are pressed into the outlet and deform. Thanks to the material selection for the rotor, the rotor blades in the hybrid pump according to the invention are stiff enough that it is sufficient to provide a guide strip for the outer edges of the rotor blades that bridges the outlet in the manner of rails. Two guide strips, above and below the outlet, respectively, that support the rotor blades when passing the outlet are particularly expedient.

Overall, the inlet will still be left in the upper side face of the pump space in the above-explained construction, but the outlet can be arranged in the running surface of the pump space and oriented tangentially. This leads to a further improvement of the hybrid pump's efficiency, since an additional deflection of the fluid stream can be omitted.

The hybrid pump according to the invention is driven in operation at rotational speeds of several thousand rpm, preferably approximately 8000 rpm.

BRIEF DESCRIPTION OF THE DRAWINGS

The invention will be described in detail below on the basis of the drawings with reference to a preferred embodiment. Additional implementations and refinements, as well as additional features, properties, aspects and advantages of the invention will be described in the course of this explanation. In the drawings

DETAILED DESCRIPTION OF THE DRAWINGS

The illustrated embodiment shows a hybrid pump for delivering a liquid pump medium, i.e., a pump that can operate due to the design of the rotor both as a displacement machine (vane pump) and as a continuous-flow machine (centrifugal pump).

Figure 1:
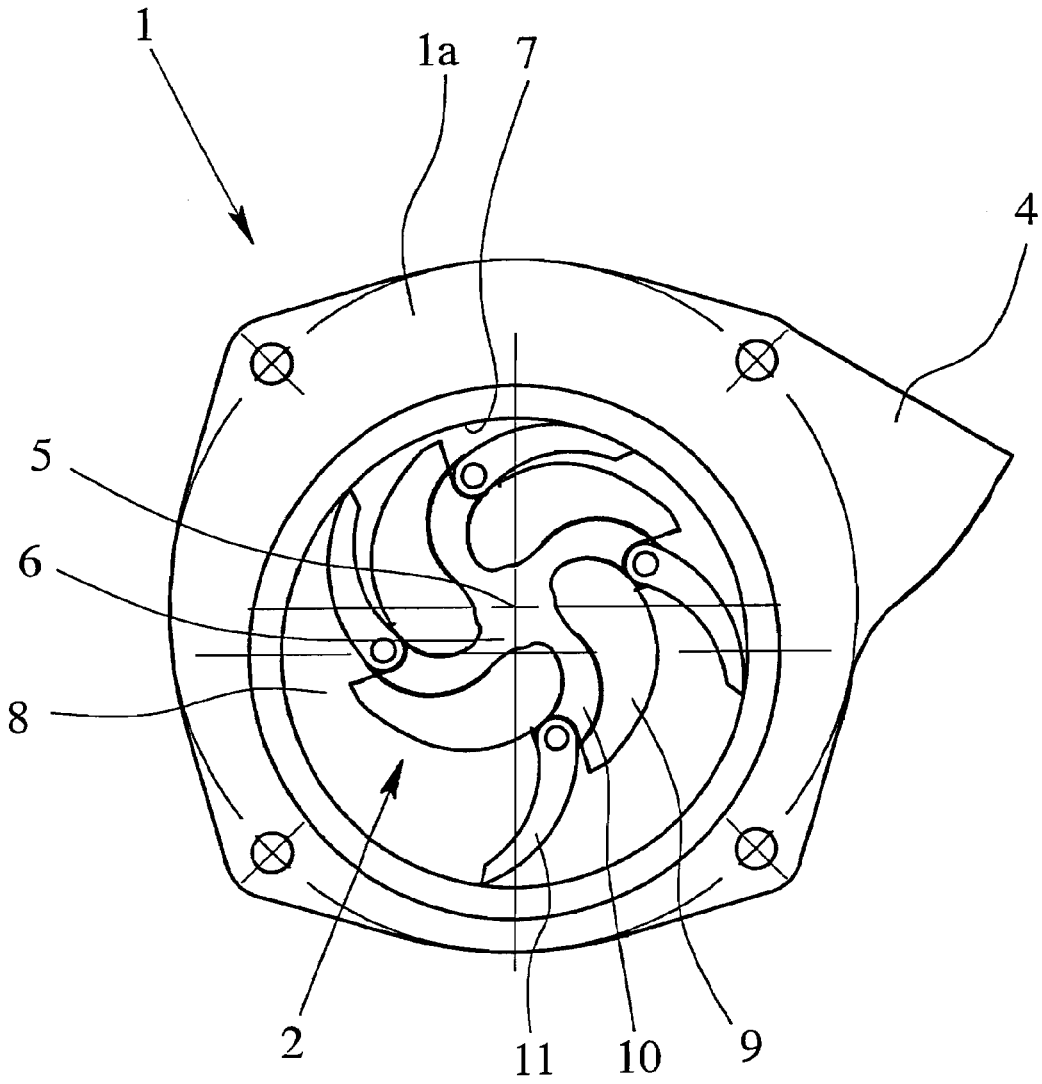
FIG. 1 shows, in an end, the lower part of the housing with the pump space and the rotor arranged therein.
Figure 2:
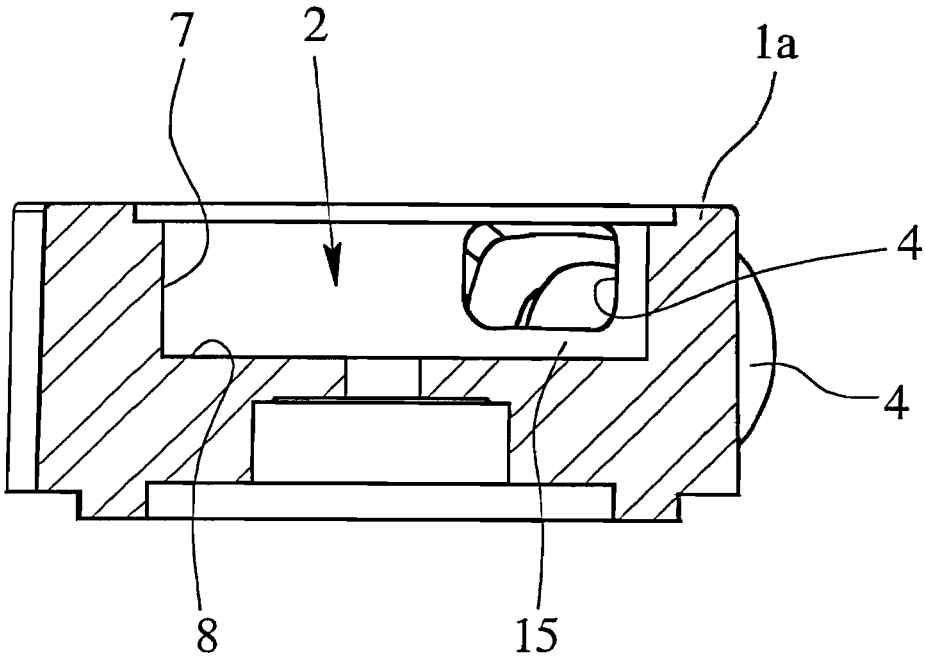
FIG. 2 shows the lower part of the housing according to FIG. 1 in section.
Figure 3:
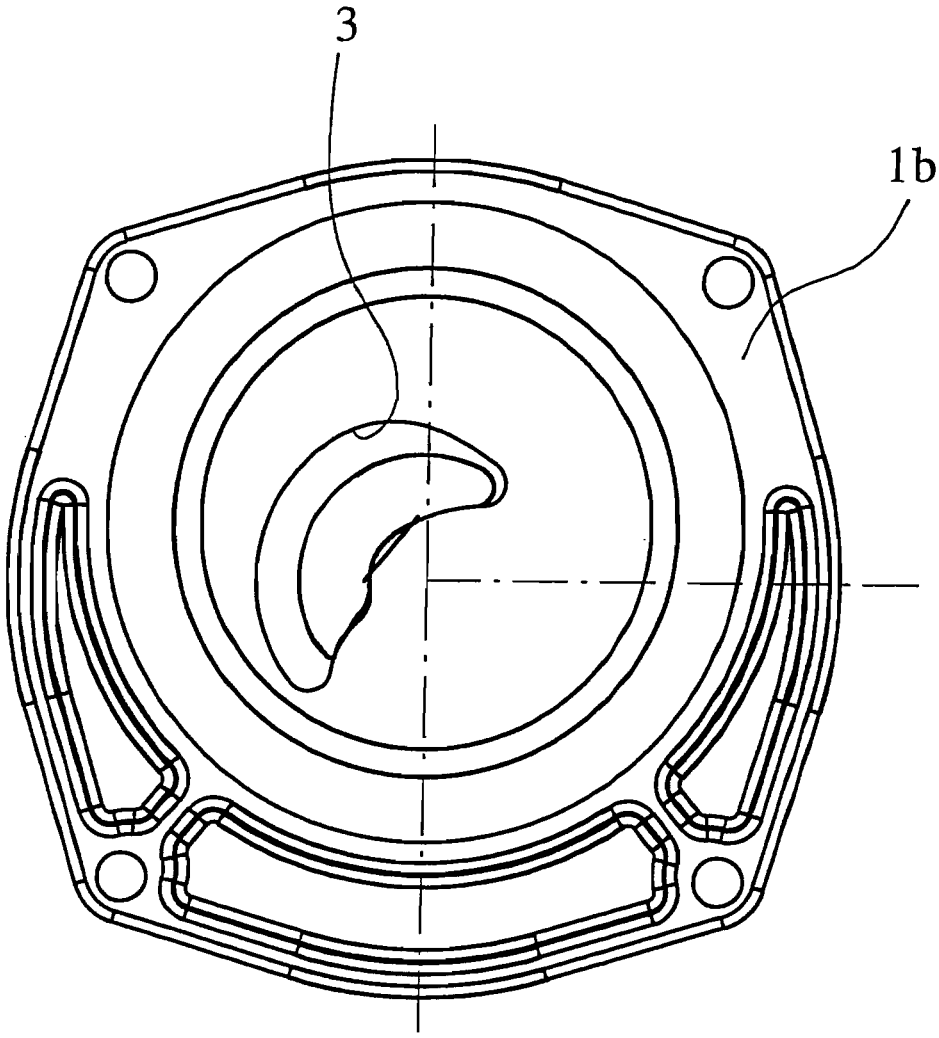
FIG. 3 shows the upper part of the housing (cover) in an end view from the side of the pump space.

The hybrid pump has a housing 1, of which one sees the lower part 1*a* in FIGS. 1 and 2, whereas FIG. 3 shows the upper part 1*b*, in practical terms the cover for lower part 1*a*. Housing 1 has a pump space 2. An inlet 3, recognizable in FIG. 3 in upper part 1*b* of housing 1, opens into pump space 2. Thus we are dealing here with an axial inlet 3, the contour of which is matched to the shape of the rotor, to be explained below.

Pump space 2 further comprises an outlet 4, recognizable in FIG. 2, that leads out of pump space 2. Outlet 4 could likewise be axially arranged as in the prior art. The illustrated and preferred embodiment, however, shows the outlet 4 departing tangentially from pump space 2. The advantages connected with this will be explained below.

A rotor 6 rotatable about a rotor axis 5 is arranged in pump space 2. In the illustrated and preferred embodiment it consists of essentially inelastic plastic. PEEK (polyether ether ketone) is particularly suitable. In particular, it should be a chemically-resistant plastic so that the hybrid pump according to the application can be used in the field of chemical applications without problem.

For the intended mode of operation it is expedient that the pump space 2 has in cross section a substantially circular running surface or an at least continuous running surface 7, differing slightly from a circular shape but still suitable for the rotational movement of rotor 6. Pump space 2 has a respective side face 8; 8' on both sides of rotor 6, i.e., not at its periphery.

In order to be able to perform the function of a displacement machine, rotor 6 is arranged eccentrically in pump space 2 relative to running surface 7. Rotor 6 has a baseplate 9 associated with the lower side face 8 of pump space 2, which is indicated in FIGS. 1 and 2. Rotor 6 is shown in detail in FIGS. 4-6. Baseplate 9 is shown, in particular, in FIGS. 5 and 6.

Rotor 6 further comprises several rotor parts 10, fixedly connected to baseplate 9, that are arranged at essentially equal intervals in the circumferential direction and extend in the installed state of rotor 6 to the opposite side face 8' of pump space 2, as indicated in FIG. 3. The unit consisting of baseplate 9 and rotor parts 10 thus represents in this sense the main body of rotor 6. This main body is shown in a perspective view in FIG. 5.

Figure 4:
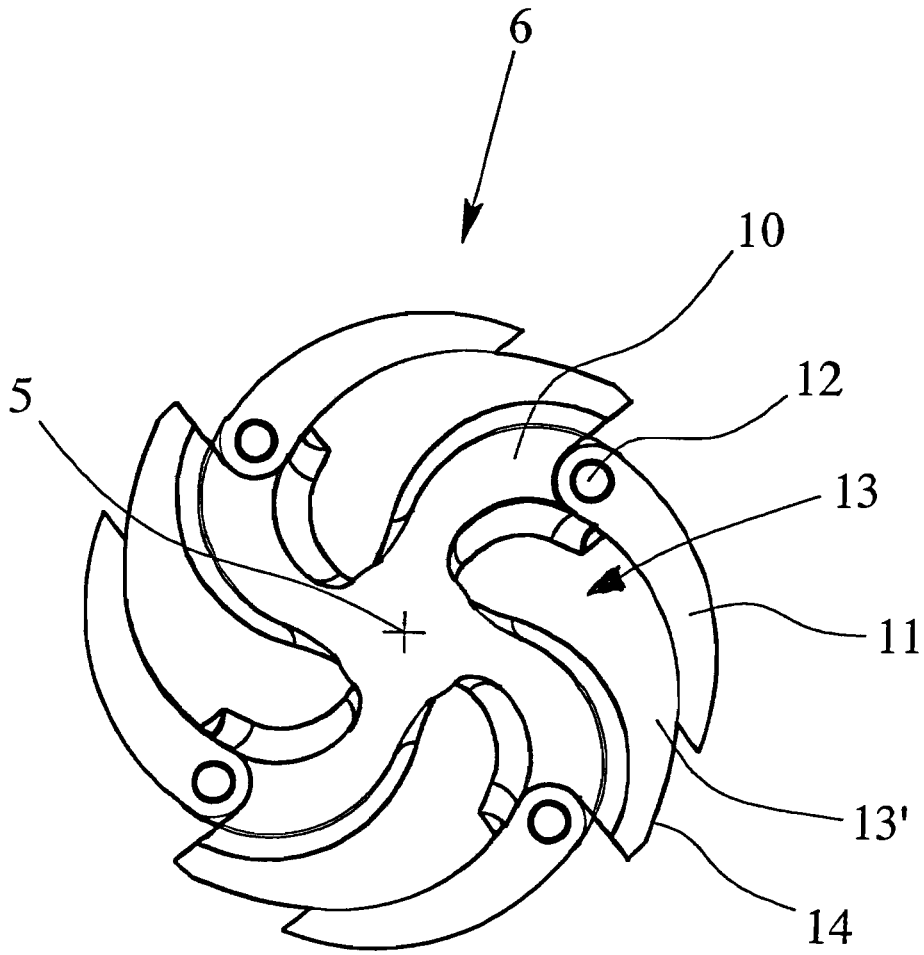
FIG. 4 shows a rotor of a hybrid pump according to the invention in an end front view.
Figure 5:
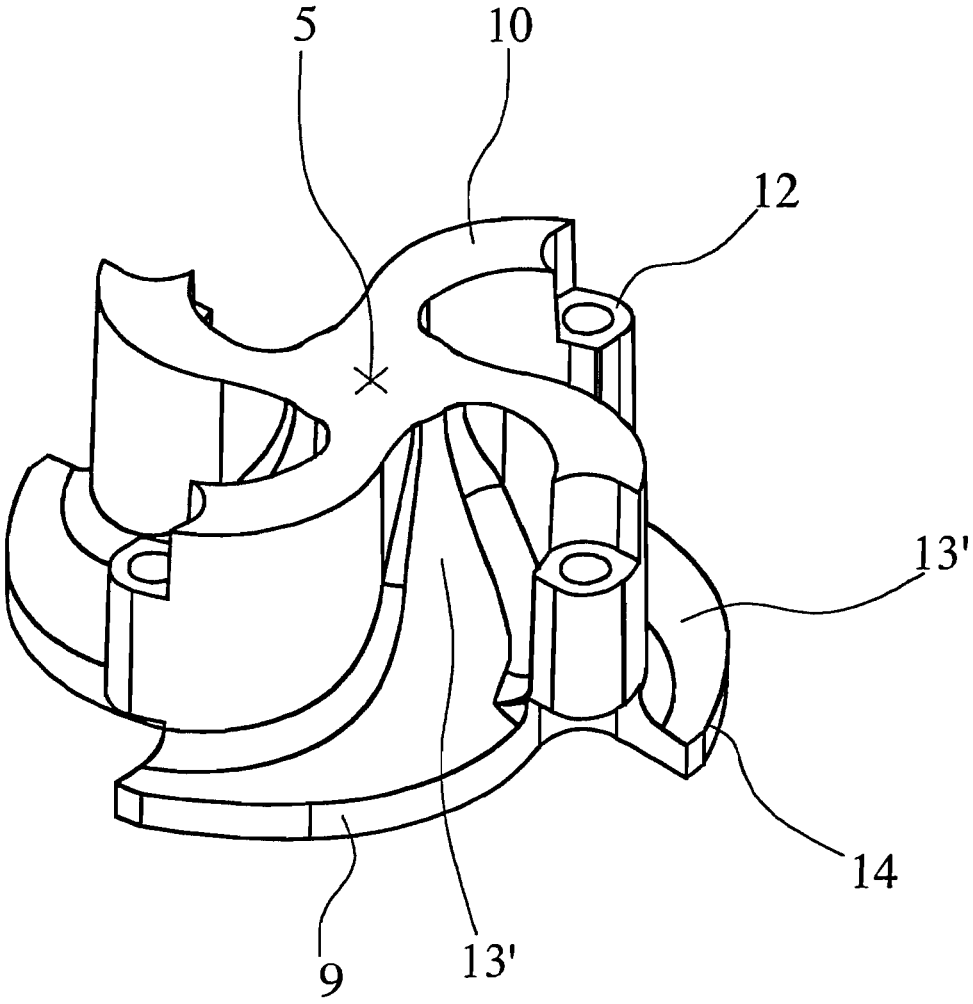
FIG. 5 shows the rotor from FIG. 4 in a perspective view, with movable rotors disassembled.

A preferably curved rotor blade 11 is pivotably hinged to the outer end of each rotor part 10. The pivot joints 12 for rotor blades 11 are seen in FIG. 4 and corresponding parts of pivot joints 12 are also seen in FIG. 5. They are likewise recognizable in FIGS. 1 and 6, but are not identified by reference numbers.

The differing positions of rotor blades 11 caused by the rotation of rotor 6 in pump space 2, which lead to the desired pumping effect, can be recognized in FIG. 1.

The pump chambers 13 of rotor 6 are formed between adjacent rotor parts 10 and rotor blades 11. They are opened towards the upper side face 8' of pump space 2 and their bottoms 13' are formed by the baseplate 9 of rotor 6.

FIG. 5 shows particularly well that the bottoms 13' of pump chambers 13 rise in a concave arc shape, starting from the outer periphery of baseplate 9, inwardly towards rotor axis 5. One also recognizes the special feature that the bottoms 13' of pump chambers 13 have an overlapping spiral-shaped profile towards rotor axis 5, thus that they are dimensionally twisted in a certain sense towards rotor axis 5.

The illustrated shape of the bottoms 13' of pump chambers 13 has the effect that the pump chambers 13 are completely filled, and the pump medium is exchanged even in the parts of the pump chambers 13 facing the rotor axis 5. Dead spaces are absent. The flow of the pump medium in pump chambers 13 is as uniform as possible.

It has already been pointed out that the rotor blades 11 are preferably constructed with a curved shape. A curved construction of rotor blades 11 corresponds to the rotational configuration of rotor 6. The advantages of curved rotor blades 11 can be recognized particularly clearly in FIG. 1. In particular, it is provided that even the stationary rotor parts 10 run in a curved shape in the circumferential direction of rotor 6. From this, the overall curved profile of pump chambers 13 results. In a plan view onto rotor 6, the bottoms 13' of pump chambers 13 each run in a curved shape following the profile of the adjacent stationary rotor part 10.

The result of the rotational asymmetry of rotor 6 is that, in the illustrated and preferred embodiment, baseplate 9 does not run in a circular shape on the outer periphery but rather has a stepwise profile. This can be recognized particularly well in FIG. 6, which shows the rear side of baseplate 9.

Figure 6:
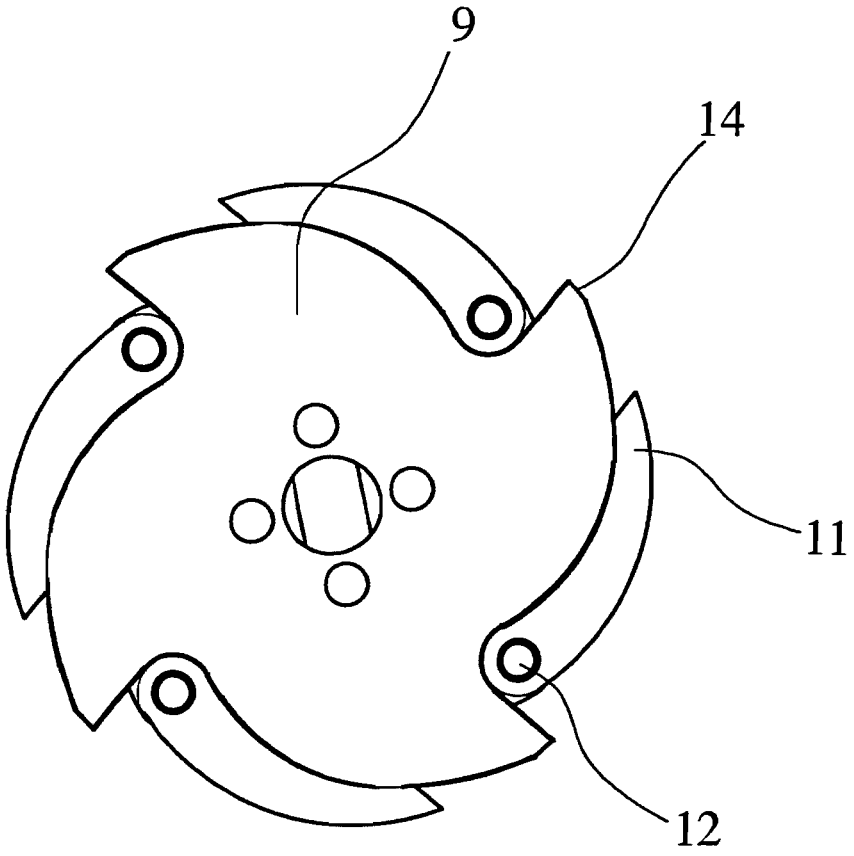
FIG. 6 shows the rotor from FIG. 4 in an end view from the rear side.

From the combination of FIGS. 5 and 6, it can be discerned that, in the illustrated and preferred embodiment, the movable rotor blades 11 extend into the plane of baseplate 9, preferably exactly up to its underside. The curved profile of the inside of rotor blades 11 matches the curved profile of the outer edge of bottoms 13', so that rotor blades 11 make good contact at the outer edges 14 of bottoms 13'. This is seen particularly well in FIGS. 4 and 6. With the rotor blades 11 in contact, this design creates pump chambers 13 that are practically closed off towards the bottom.

FIGS. 1 and 2 in combination reveal that, in the illustrated and preferred embodiment, as already mentioned above, outlet 4 of pump space 2 is arranged in running surface 7 of pump space 2. Thus the rotor blades 11 permanently pass over outlet 4 during rotation of rotor 6 at a high rotational speed, for example, 8000 rpm. Even if the material of rotor 6 and its rotor blades 11 consisting of plastic is largely inelastic and non-resilient, considerable wear on the radially outward ends of rotor blades 11 results from the continuous striking of the edges of outlet 4.

According to the invention, it is provided here that at least one guide strip 15 bridging outlet 4 in the manner of a rail is provided for at least one outer edge of rotor blades 11. In FIG. 2, this is the lower guide strip 15 to the lower side surface 8. Preferably, one guide strip is provided, respectively, above and below the outlet, so that the outer ends of rotor blades 11 run completely uniformly across outlet 4.

What is claimed is:

1. A hybrid pump for delivering a liquid pump medium, the hybrid pump comprising:

a housing that has a pump space, an inlet opening into the pump space, and an outlet leading out of pump space;

a rotor that is arranged in the pump space, is rotatable about a rotor axis, and is made of inelastic plastic;

wherein the pump space has a rounded running surface and a respective side face on opposite sides of rotor;

wherein the rotor is eccentrically arranged in the pump space relative to the running surface;

wherein the rotor has a baseplate associated with a lower side face of the pump space and several rotor parts arranged at uniform intervals in the circumferential direction extending towards one of the side faces of the pump space and fixedly connected to the baseplate;

wherein a curved rotor blade is pivotably hinged to the outer end of each rotor part and wherein, between adjacent rotor parts and rotor blades, pump chambers are formed that are open to the upper side face of the pump space, wherein bottoms of the pump chambers are formed by the baseplate of the rotor;

wherein the bottoms of the pump chambers rise in a concave curved shape from an outer edge of the baseplate inwardly towards the rotor axis.

2. The hybrid pump according to claim 1, wherein the bottoms of pump chambers have an overlapping spiral-shaped profile towards the rotor axis.

3. The hybrid pump according to claim 1, wherein the rotor parts are stationary and run in a curved shape in the circumferential direction of rotor and wherein as viewed in a plan view onto rotor, each bottom of the pump chambers runs radially outwards in a curved shape following a profile of an adjacent stationary rotor part.

4. The hybrid pump according to claim 3, wherein the baseplate has a stepwise profile at its outer periphery.

5. The hybrid pump according to claim 1, wherein the movable rotor blades extend into the plane of baseplate, and wherein the profile of the inside of the rotor blades matches a profile of the outer edge of bottoms, so that the rotor blades make good contact at outer edges of the bottoms.

6. The hybrid pump according to claim 1, wherein the outlet is arranged in the running surface of pump space, and comprising at least one guide strip bridging outlet in the manner of a rail at least one outer edge of rotor blades.

7. The hybrid pump according to claim 1, wherein the plastic is chemically resistant.

8. The hybrid pump according to claim 1, wherein the plastic is PEEK.

9. The hybrid pump according to claim 1, wherein the pump space has a circular running surface.

10. The hybrid pump according to claim 5, wherein the movable rotor blades extend into the plane of the baseplate exactly up to an underside of the baseplate.

11. The hybrid pinup according to claim 6, wherein one respective guide strip is provided above and below the outlet.

12. The hybrid pump according to claim 6, wherein a guide strip is provided above the outlet and a guide strip is provided below the outlet.

13. A hybrid pump for delivering a liquid medium, the hybrid pump comprising:

a housing that has a pump space, an inlet into which the liquid medium enters the pump space, and an outlet out from which liquid medium leaves the pump space;

an inelastic, plastic rotor disposed in the pump space for rotation about a rotor axis;

wherein the pump space has a rounded running surface and wherein the rotor is eccentrically arranged in the pump space relative to the running surface;

wherein the rotor has a lower baseplate and a plurality of rotor parts that are connected to the baseplate and are spaced apart from each other at circumferential intervals around the rotor; wherein the baseplate and each rotor part in the plurality of rotor parts radially outwardly extend from the rotor axis; and a plurality of curved rotor blades, each curved rotor blade in the plurality being pivotably connected to a rotor part in the plurality of rotor parts;

wherein a plurality of pump chambers are defined by adjacent rotor parts in the plurality of rotor parts, by a rotor blade in the plurality of curved rotor blades, and by the baseplate; each pump chamber in the plurality of pump chambers having an open upper side face; and wherein each pump chamber has a bottom surface that rises in a concave, curved shape from an outer edge of the baseplate radially inwardly towards the rotor axis.

14. The hybrid pump according to claim 13, wherein the bottom surface of each pump chamber has an overlapping spiral-shaped profile that extends towards the rotor axis.

15. The hybrid pump according to claim 13, wherein each rotor part remains stationary with respect to the housing.

16. The hybrid pump according to claim 15, wherein each rotor part has a curved shape when the rotor is viewed in plane view.

17. The hybrid pump according to claim 16, wherein each bottom surface of the pump chamber has a curved shape that follows a curved shape of a respective rotor part when the rotor is viewed in plane view.

18. The hybrid pump according to claim 17, wherein the baseplate comprises an outer periphery having a stepwise profile.

19. The hybrid pump according to claim 13, wherein each curved rotor blade extends into a plane defined by the baseplate.

20. The hybrid pump according to claim 19, wherein each curved rotor blade has an inside surface with a curved profile, and wherein the bottom surface of each pump chamber has a curved profile; and wherein the curved profile of the inside surface aligns with the curved profile of the bottom surface so that each curved rotor blade contacts an outer edge of a respective bottom surface of a pump chamber in the plurality of pump chambers.

* * * * *